United States Patent [19]

Rose

[11] 4,202,492

[45] May 13, 1980

[54] AIR CIRCULATION SYSTEM

[76] Inventor: Larry A. Rose, P.O. Box 15, Darby, Mont. 59829

[21] Appl. No.: 938,462

[22] Filed: Aug. 31, 1978

[51] Int. Cl.[2] ..... F24F 7/00

[52] U.S. Cl. ..... 236/49; 200/219; 337/308

[58] Field of Search ..... 236/49, 91 R; 165/16; 62/412; 337/308, 331; 200/220, 219, 215

[56] References Cited

U.S. PATENT DOCUMENTS

| | | | |
|---|---|---|---|
| 1,654,523 | 1/1928 | Bihl | 337/331 X |
| 1,691,666 | 11/1928 | Muffly | 200/220 X |
| 2,037,155 | 4/1936 | Stuart | 337/308 X |
| 2,067,959 | 1/1937 | Wasson | 236/91 R X |
| 2,474,369 | 6/1949 | Ray | 337/331 X |
| 3,493,175 | 2/1970 | Fogarty et al. | 337/308 X |
| 4,023,947 | 5/1977 | Ferry | 62/412 X |
| 4,147,038 | 4/1979 | Hoebing et al. | 62/412 X |

*Primary Examiner*—William E. Wayner
*Assistant Examiner*—Harry Tanner
*Attorney, Agent, or Firm*—Arthur L. Urban

[57] ABSTRACT

An air circulation system including an enclosure, air circulating devices for conveying ambient temperature air into the enclosure, actuating apparatus for the air circulating devices including a supporting frame, an upwardly extending support member adjacent each end of the supporting frame, a pair of rods each having one end affixed adjacent the end of one of the support members with their free ends extending toward and spaced from one another, a mercury bulb switch suspended between the free ends of the rods, rod deflection assemblies disposed along the length of each of the rods, each of the rod deflection assemblies including an expandable fluid chamber mounted on the supporting frame and operatively connected to one of the rods, a sensing element operatively connected to each of the rod deflection assemblies, one of the sensing elements being located outside the enclosure and the other sensing element positioned inside the enclosure, each of the sensing elements including a sealed hollow bulb connected by tubing to one of the expandable fluid chambers to form a closed atmosphere therewith, and lead wires electrically connecting the mercury bulb switch with the air circulating devices.

10 Claims, 2 Drawing Figures

AIR CIRCULATION SYSTEM

This invention relates to a novel system for circulating air and more particularly relates to a new system for circulating ambient temperature air through an enclosure.

Various systems have been devised for heating or cooling enclosed areas. Heating generally is accomplished by the burning of a fuel or the use of an electrical heating element. Cooling ordinarily is achieved with a refrigeration system which is powered by electricity or in some cases by gas. In both heating and cooling, a considerable amount of electricity or burnable fuel is required to accomplish the desired change in temperature.

With the recent large increase in the cost of electricity and petroleum products and with significant additional increases expected in the future, much attention is being directed to alternative ways of heating and cooling. The search not only is for primary sources of heat and cold, but also for ways of reducing heating and cooling requirements below present levels.

The use of solar energy for heating or cold air or cold water for cooling are well known. In their simplest form, such heating and cooling is achieved by manually opening and closing valves, doors, blinds, vents, etc. or by manually switching on and off pumps, fans, etc.

While a variety of automatic control systems are commercially available, such systems generally are complicated in design and expensive. Furthermore, such systems usually are very difficult to install and maintain and therefore these services must be performed by specially trained technicians. This service can be a significant expense during the life of the equipment.

The present invention provides a novel air circulation system for heating and cooling with a minimum of expense. The air circulation system of the invention provides supplemental heating or cooling automatically without attention or manual actuation of the system. Moreover, the air circulation system does not begin its operation unless ambient conditions will provide the desired temperature change.

The air circulation system of the invention is simple in design and can be fabricated from commercially available components relatively inexpensively. Also, the air circulation system can be installed, maintained and repaired by individuals with ordinary mechanical and electrical skills with a minimum of instruction and without special training or special tools.

Figure 1:
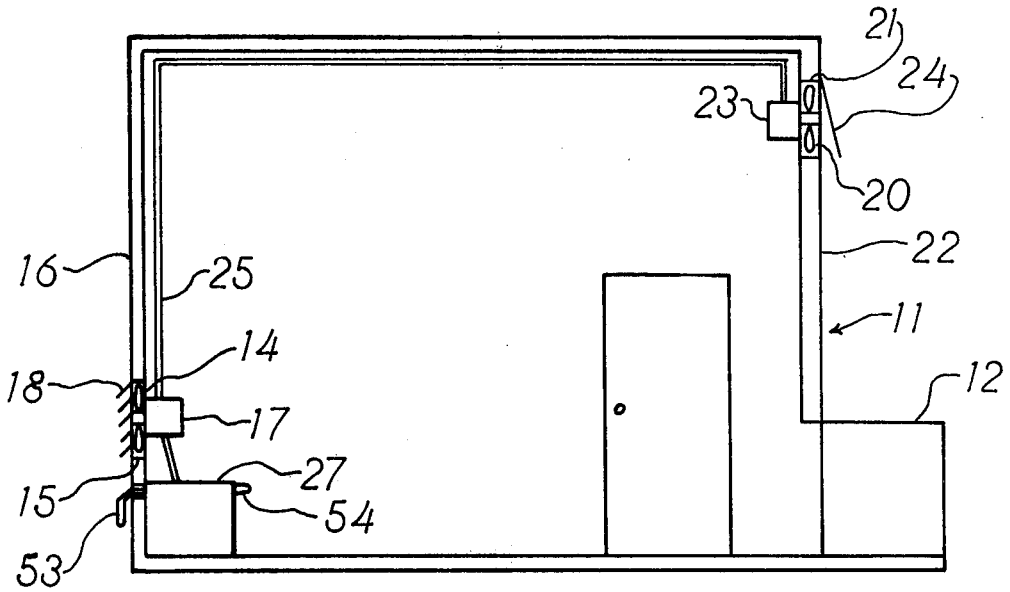
Figure 2:
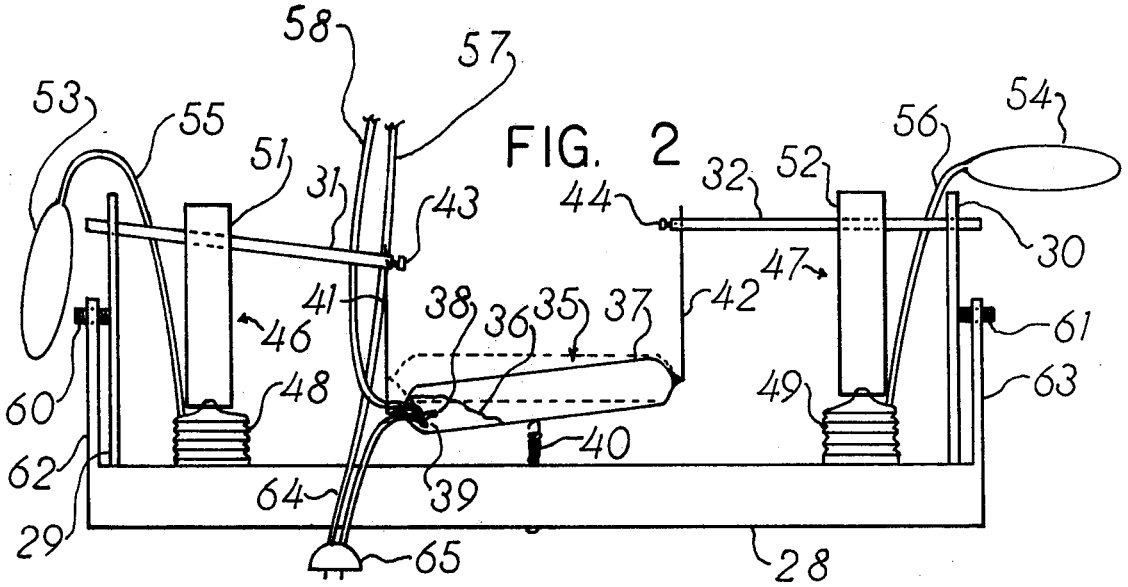

Other benefits and advantages of the novel air circulation system of the present invention will be apparent from the following description and the accompanying drawings in which:

FIG. 1 is a schematic illustration of one form of the air circulation system of the invention; and FIG. 2 is a greatly enlarged side elevation of the control portion of the air circulation system shown in FIG. 1.

As shown in the drawings, one form of the novel air circulation system of the present invention is installed in an enclosure 11 such as an insulated cold storage room or a heated drying room. Primary heating or cooling is supplied to the enclosure 11 with a commercial unit 12 which may be a refrigeration unit for cooling or a heater for heating.

The air circulation system of the invention includes air circulating means shown as intake blower fan 14 mounted in opening 15 located in a sidewall 16 of enclosure 11. Fan 14 is driven by an electric motor 17. Pivoting louvers 18 cover the outside of opening 15. If desired as shown, a second exhaust blower fan 20 may be disposed in a second opening 21 of and opposite sidewall 22. Fan 20 is driven by an electric motor 23. A pivoting door 24 may be located over opening 21. Blowers 14 and 20 are connected electrically through lead wires 25.

Control portion 27 of the air circulation system of the invention includes a supporting frame 28 with support members 29 and 30 extending upwardly adjacent each end thereof. A pair of rods 31 and 32 each have one end affixed adjacent the free end of one of the support members 29 and 30. This provides a cantilever arrangement of the rods 31 and 32 with respect to the support members 29 and 30. The free ends of the rods 31 and 32 extend toward each other with the rods spaced from one another. Advantageously, the rods 31 and 32 are disposed in a generally horizontal plane.

Control portion 27 also includes a switch 35 of the type commercially available in which mercury 36 is disposed in glass bulb 37 and moves back and forth as the bulk is tilted. When the mercury 36 is at the left end of bulb 37, an electrical circuit is completed between the exposed ends 38 and 39 of lead wires extending into the bulb. Preferably, the center portion of switch 35 is connected to supporting frame 28 with biasing means shown as spring 40.

The mercury switch 35 is suspended between the adjacent free ends of rods 31 and 32. Advantageously, the switch 35 is suspended from the rods by flexible connecting means such as metal or textile wires, cables, cords or the like. Preferably, means shown as set screws 43 and 44 facilitate changing the length of the wires 41 and 42 to adjust the position of the mercury switch 35. The position of mercury switch 35 also may be adjusted by means shown as set screws 60 and 61 carried by extensions 62 and 63 of supporting frame 28. The ends of the set screws bear against upstanding support members 29 and 30.

Rod deflection means 46 and 47 are positioned along the length of each of the rods 31 and 32. As shown, each rod deflector includes an expandable fluid chamber 48 and 49 mounted on supporting frame 28 and operatively connected to rods 31 and 32, respectively. Expandable fluid chambers 48 and 49 advantageously are expandable bellows. Preferably, the bellows are connected to rods 31 and 32 through rigid connectors such as bars 51 and 52.

Sensing elements are operatively connected to the expandable fluid chambers 48 and 49. Each sensing element includes a hollow bulb 53 and 54 connected by tubing 55 and 56 to one of the chambers 48 and 49. Advantageously, hollow bulbs 53 and 54, tubing 55 and 56 and bellows 48 and 49 are formed of copper. Lead wires 57 and 58 electrically connect the exposed lead ends 38 and 39 of mercury switch 35 with blowers 14 and 20.

In the operation of the air circulation system shown in the drawings, the control portion 27 is connected electrically with lead wires 64 to a power source shown as outlet plug 65. With a cold storage room 11, unit 12 would be a refrigeration unit to provide a primary source of cooling. However, on cool days or nights when the temperature outside of the cold storage room is lower than that in the enclosure, the pressure of the atmosphere inside hollow bulb 53 will be lower than the pressure of the atmosphere inside hollow bulb 54. Since hollow bulb 53 is connected with bellows 48 through tubing 55, the pressure in bellows 48 will be lower than the pressure in bellows 49 which is connected to bulb 54.

The reduced pressure in bellows 53 will cause the height of the bellows to be reduced so that bar 51 attached thereto will be lowered, drawing down rod 31. The dropping of rod 31 will cause the left end of mercury switch 35 to drop so the mercury 36 therein will run down to the left end and complete an electrical circuit through wire ends 38 and 39. Completing the circuit activates motor 17 so fan 14 will draw cool air from outside into room 11. Simultaneously, motor 23 drives fan 20 to exhaust the warmer air from the room. The opening of louvers 18 and door 24 is coordinated with the operation of fans 14 and 20.

When the temperature of the air in room 11 is lowered by the air from the outside, the pressure in hollow bulb 54 will be reduced. This will reduce the pressure within bellows 54 causing it to shrink in height and drawn down bar 52 and rod 32 attached thereto. This action will cause the right end of switch 35 to drop so that mercury 36 will run away from the wire ends 38 and 39 and open the circuit. Opening the circuit will cut the electrical power to motors 17 and 23 stopping them. If the outside temperature again drops below the room temperature, the pressure in bulb 53 will be lower than the pressure in bulb 54 so that the height of bellows 48 will be less than that of bellows 49. This difference in the height of the bellows will be evident in a height difference of rods 31 and 32. This will produce a tilting of switch 35 with the left end lower so the mercury 36 will run down to complete a circuit through wire ends 38 and 39 again, beginning the operation of fans 14 and 20.

In the situation where room 11 is employed as a hot drying room, fans 14 and 20 will operate when the outside temperature is higher than that of the room. Under these conditions, the pressure of outside bulb 53 will be greater than that of inside bulb 54. This will produce a difference in the heights of bellows 48 and 49, with that of bellows 48 being greater. To activate switch 35 under these conditions, the switch will be reversed so the wire ends will be located at the right end of the switch. In this case, raising of the left end of the switch will cause the mercury 36 to run to the lowered right end to complete the circuit and activate the fans 14 and 20.

The above description and the accompanying drawings show that the present invention provides a novel air circulation system which can be operated with a minimum of expense. The air circulation system of the invention is simple in design and can be fabricated from commercially available components relatively inexpensively. Furthermore, the air circulation system can be installed, maintained and repaired by persons with ordinary mechanical and electrical skills with a minimum of instruction and without special training and special tools.

The air circulation system of the invention provides automatic operation of a supplementary heating or cooling system. In addition, the air circulation system provides control of the heating or cooling operation until the ambient conditions will provide the desired temperature change.

It will be apparent that various modifications can be made in the particular air circulation system described in detail above and shown in the drawings within the scope of the invention. For example, the size and arrangement of the components may be changed to meet specific requirements. Also, supplemental thermostats or other controls may be combined with the system of the invention to provide additional control of the operation of the system. In addition, the materials utilized in the fabrication of the control portion of the system may be different as desired. Further, only one blower fan may be used under certain conditions. Therefore, the scope of the invention is to be limited only by the following claims.

What is claimed is:

1. An air circulation system including an enclosure, air circulating means for conveying ambient temperature air into said enclosure, means for actuating said air circulating means including a supporting frame, an upwardly extending support member adjacent each end of said supporting frame, a pair of rods each having one end affixed adjacent the end of one of said support members with their free ends extending toward and spaced from one another, a mercury switch suspended between the free ends of said rods, rod deflection means disposed along the length of each of said rods, each of said rod deflection means including an expandable fluid chamber mounted on said supporting frame and operatively connected to one of said rods, a sensing element operatively connected to each of said rod deflection means, one of said sensing elements being located outside of said enclosure and the other sensing element positioned inside said enclosure, each of said sensing elements including a sealed hollow bulb connected by tubing to one of said expandable fluid chambers to form a closed atmosphere therewith, and means for electrically connecting said mercury switch with said air circulating means.

2. An air circulation system according to claim 1 wherein said rods are disposed in a generally horizontal plane.

3. An air circulation system according to claim 1 wherein said mercury switch includes a bulb suspended from said rods by flexible connecting means.

4. An air circulation system according to claim 1 wherein said rod deflection means includes expandable bellows.

5. An air circulation system according to claim 1 wherein each of said rod deflection means is connected to each of said rods through rigid connecting means.

6. An air circulation system according to claim 3 wherein the center portion of said mercury bulb switch is connected to said supporting frame with biasing means.

7. An air circulation system according to claim 1 wherein said sensing elements, said tubing and said rod deflection means are formed of copper.

8. An air circulation system according to claim 1 wherein said air circulating means includes a pair of blowers.

9. An air circulation system according to claim 3 including means for changing the length of said flexible connecting means to adjust the position of said mercury bulb switch.

10. An air circulation system according to claim 1 including means for adjusting the relative positions of said free rod ends.

* * * * *